US005233398A

United States Patent [19]

Nimura et al.

[11] Patent Number: 5,233,398

[45] Date of Patent: Aug. 3, 1993

[54] CLEANING UNIT FOR REMOVING RESIDUAL TONER ON PHOTORECEPTOR DRUM FOR USE IN IMAGE FORMING APPARATUS

[75] Inventors: Eiji Nimura, Tondabayashi; Wataru Yoshida, Hirakata; Michio Uchida, Nara, all of Japan

[73] Assignee: Mita Industrial Co., Ltd., Osaka, Japan

[21] Appl. No.: 875,016

[22] Filed: Apr. 28, 1992

[30] Foreign Application Priority Data

May 2, 1991 [JP] Japan ..... 3-130350
May 13, 1991 [JP] Japan ..... 3-107625

[51] Int. Cl.[5] ..... G03G 21/00

[52] U.S. Cl. ..... 355/301; 355/302; 355/303

[58] Field of Search ..... 355/296, 297, 298, 301, 355/302, 303

[56] References Cited

U.S. PATENT DOCUMENTS

| | | | |
|---|---|---|---|
| 4,819,026 | 4/1989 | Lange et al. . | |
| 4,870,466 | 9/1989 | Iida | 355/297 |
| 4,878,093 | 10/1989 | Edmunds | 355/296 |
| 4,999,679 | 3/1991 | Corbin et al. | 355/303 |
| 5,031,000 | 7/1991 | Pozniakas et al. | 355/297 |

FOREIGN PATENT DOCUMENTS

| | | | |
|---|---|---|---|
| 57-30869 | 2/1982 | Japan | 355/301 |
| 1-167871 | 7/1989 | Japan | 355/301 |
| 1-170976 | 7/1989 | Japan | 355/301 |
| 1-295289 | 11/1989 | Japan | 355/301 |

*Primary Examiner*—A. T. Grimley
*Assistant Examiner*—Nestor R. Ramirez
*Attorney, Agent, or Firm*—Beveridge, DeGrandi, Weilacher & Young

[57] ABSTRACT

A cleaning unit includes a plurality of rotatable fur brushes which are arranged so as to adjoin in a downstream direction of a transferring process on a surface of a photoreceptor drum and whose tips are in contact with the surface for removing residual toner on the surface, recovering rollers arranged so as to be in contact with the tip of each of the fur brushes for removing toner adhering to the fur brushes, and a charger for charging the fur brushes and the recovering rollers, wherein the fur brush arranged at the downmost stream side rotates at a lower speed compared to another fur brush arranged in the upstream side thereof, wherein a discharger is further provided for decreasing the charge of the residual toner, and wherein the charger charges the downmost stream side fur brush reversely to the uppermost stream side fur brush.

4 Claims, 4 Drawing Sheets

CLEANING UNIT FOR REMOVING RESIDUAL TONER ON PHOTORECEPTOR DRUM FOR USE IN IMAGE FORMING APPARATUS

BACKGROUND OF THE INVENTION

1. Field of the Invention

The present invention relates to a cleaning unit for removing residual toner on a photoreceptor drum surface for use in an image forming apparatus such as an electrophotographic copying machine and printer, and more particularly, to a cleaning unit for removing residual toner by user of a fur brush.

2. Description of the Prior Art

Conventionally, a cleaning unit for removing residual toner on a surface of a photoreceptor drum is provided. The cleaning unit is arranged at a portion corresponding to a downstream side of a transferring process so as to face the surface of the photoreceptor drum. As shown in FIG. 1, a fur brush 4 whose tip is in contact with the surface 1 is arranged in the cleaning unit. To the fur brush 4, a recovering roller 5 is provided so that the tip of the fur brush is in contact therewith. In the downstream side of the fur brush 4, a blade 301 whose one end is in contact with the surface 1 is arranged in order to remove toner which cannot be removed by the fur brush 4. Moreover, at a position below the recovering roller 5, a toner tray 303 for storing removed toner and a screw roller 304 for returning the toner gathered in the toner tray 303 to a toner hopper are arranged. One end of the toner tray 303 is arranged to adjoin the surface 1 so that the removed toner does not spill out of the tray 303. Below the recovering roller 5, a blade 302 for removing toner adhering to the roller 5 is arranged so as to be in contact therewith. To the fur brush 4 and the recovering roller 5, potential applying means 6 is connected for separating residual toner from the surface 1 by electrically attracting it.

A part of toner which has not been transferred remains on the surface 1 where toner has been transferred onto a copy sheet by the transferring process 2. The surface 1 to which the residual toner adheres rotates to the fur brush 4. Since the fur brush 4 rotates and is provided with a potential of a pole reverse to that of the toner by the potential applying means 6, the residual toner adheres to the brush 4 because of frictional force and electrical attraction. The toner adhering to the fur brush 4 is conveyed to the recovering roller 5. When the brush is in contact with the surface of the roller, the toner adhering to the fur brush 4 is attracted by the recovering roller 5 and adheres thereto, since the recovering roller 5 is provided with a potential higher than that of the fur brush 4. The toner adhering to the recovering roller 5 is rubbed off by the blade 302 which is in contact with the roller 5, and is dropped onto the toner tray 303.

Moreover, since the residual toner cannot completely be removed only by the fur brush 4 because of electrical attraction between the toner and the surface 1, a part of the toner still remains on the surface 1. Although the remaining toner is mechanically removed by the blade 301, a part of toner adheres to the edge of the blade 301.

In order to separate residual toner from the surface 1, it is necessary that the number of rotation of the fur brush 4 be approximately 200 rpm. Because of the rotation of the fur brush 4, the residual toner scatters. The blade 301 arranged in the downstream side of the fur brush 4 also prevents the scattering of toner.

As described above, however, the toner adhering to the edge of the blade 301 re-adheres to the surface 1, whereby mal-cleaning occurs in a copying operation for a first copy sheet. Moreover, the adhesive power of granular and spherical toner to the surface 1 is so strong that cleaning cannot effectively be performed by a conventional cleaning unit which employs a fur brush or a blade.

Moreover, in this prior art, to the fur brush 4 which is in contact with the surface 1, a positive voltage E1 is applied by a DC current source 6. Because of this, the fur brush 4 electrostatically attracts negatively charged toner remaining on the surface 1. However, since the positively charged toner cannot be recovered from the surface 1, it is impossible to recover the positively charged toner onto the recovering roller 5. Therefore, in this prior art, residual toner adhering to the surface of the photoreceptor drum cannot completely be removed.

SUMMARY OF THE INVENTION

An object of the present invention is to provide a cleaning unit where mal-cleaning does not occur, where a blade for preventing the scattering of toner is unnecessary and where cleaning of granular and spherical toner is effectively performed.

Another object of the present invention is to provide a cleaning unit where both positively and negatively charged toner can be removed.

To achieve the above-mentioned objects, a cleaning unit of the present invention is provided with a plurality of rotatable fur brushes which are arranged so as to adjoin in a downstream direction of a transferring process on a surface of a photoreceptor drum and whose tips are in contact with said surface for removing residual toner on said surface, a recovering roller which rotates in order to remove toner adhering to said fur brushes and which is arranged so as to be in contact with the tip of each of said fur brushes, and potential applying means for applying potential to said fur brushes and said recovering roller, wherein a fur brush arranged at the downmost stream side rotates continuously or intermittently at a lower speed compared to another fur brush arranged in the upstream side thereof.

BRIEF DESCRIPTION OF THE DRAWINGS

These and other objects and features of this invention will become clear from the following description taken in conjunction with the preferred embodiments with reference to the accompanied drawings in which.

DESCRIPTION OF THE PREFERRED EMBODIMENTS

An embodiment of the present invention will hereinafter be described with reference to the drawings.

Figure 1:
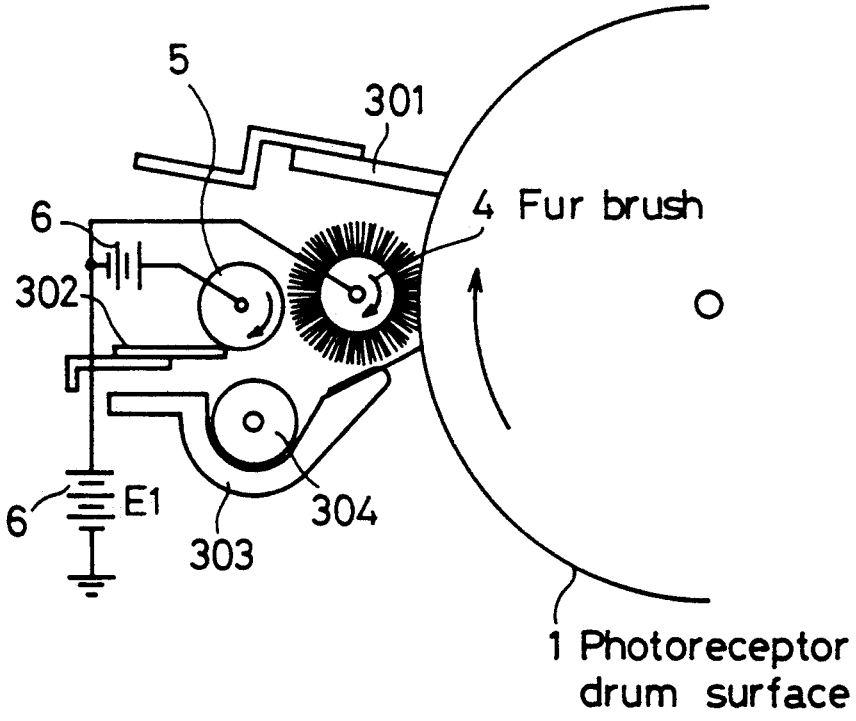
Fig. 1 Prior art
FIG. 1 is a schematic view of a conventional cleaning unit.
Figure 2:
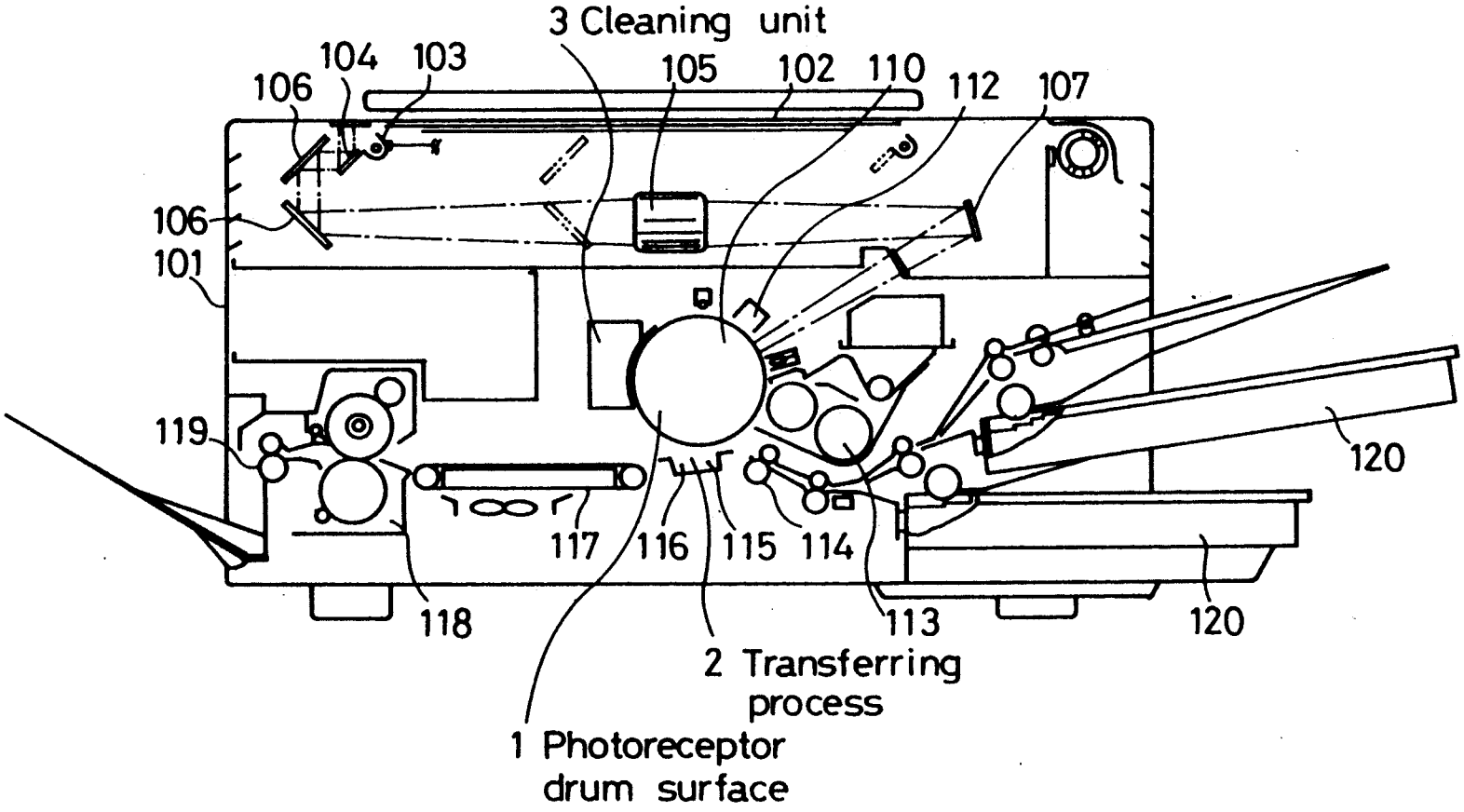
FIG. 2 is a schematic cross-sectional view of an electrophotographic copying machine provided with a cleaning unit of the present invention.

FIG. 2 is a schematic cross-sectional view of an electrophotographic copying machine including an embodiment of an cleaning unit of the present invention. An original glass plate 102 on which an original to be copied is placed is provided on the upper surface of a casing 101 of the body of the copying machine. The inside of the casing 101 is divided into an upper and a lower portions. In the upper portion, of the casing 101, which is below the original glass plate 102, an exposure lamp 103 and a mirror 104 which can move as a pair from the downstream end to the upstream end, a pair of movable mirrors 106 for causing a light beams irradiated onto the original to enter a lens 105 arranged below the center of the original glass plate 102, and a fixed mirror 107 for causing the light beams having passed through the lens 105 to expose a surface 1 of a photoreceptor drum are arranged.

Moreover, a photoreceptor drum 110 having the photosensing sensing surface 1 is arranged in the center of the lower portion of the casing 101. A charging electrode 112 for primary charging is arranged to adjoin the upstream side of an image-formed point of the surface 1. In the downstream side of the charging electrode 112, a developer unit 113 for causing toner to adhere to the surface 1 is arranged. In the downstream side of the developer unit 113, a paper feed roller 114 for feeding a copy sheet is arranged. In the downstream side of the roller 114, a transferring electrode 115 for transferring toner on the surface 1 onto a copy sheet (a transferring process 2) is arranged. In the downstream side of the transferring electrode 115, a separating electrode 116 for separating a copy sheet from the surface 1 is arranged to adjoin the transferring electrode 115.

At a position adjoining the surface 1, which is in the downstream side of the separating electrode 116, a cleaning unit 3 is provided for removing residual toner on the surface 1 after copying.

Moreover, away from the separating electrode 116 and the photoreceptor drum 110, in a direction of the paper discharging side, a paper conveying belt 117 is provided for conveying a copy sheet onto which toner has been transferred to the fixing side. In the paper discharging side of the belt 117, a fixing unit 118 is arranged. In the paper discharging side of the fixing unit 118, a discharging roller 119 is arranged. Moreover, in the paper feeding side, a plurality of paper feed cassettes 120 in which copy sheets of different sizes are set is attached.

Figure 3:
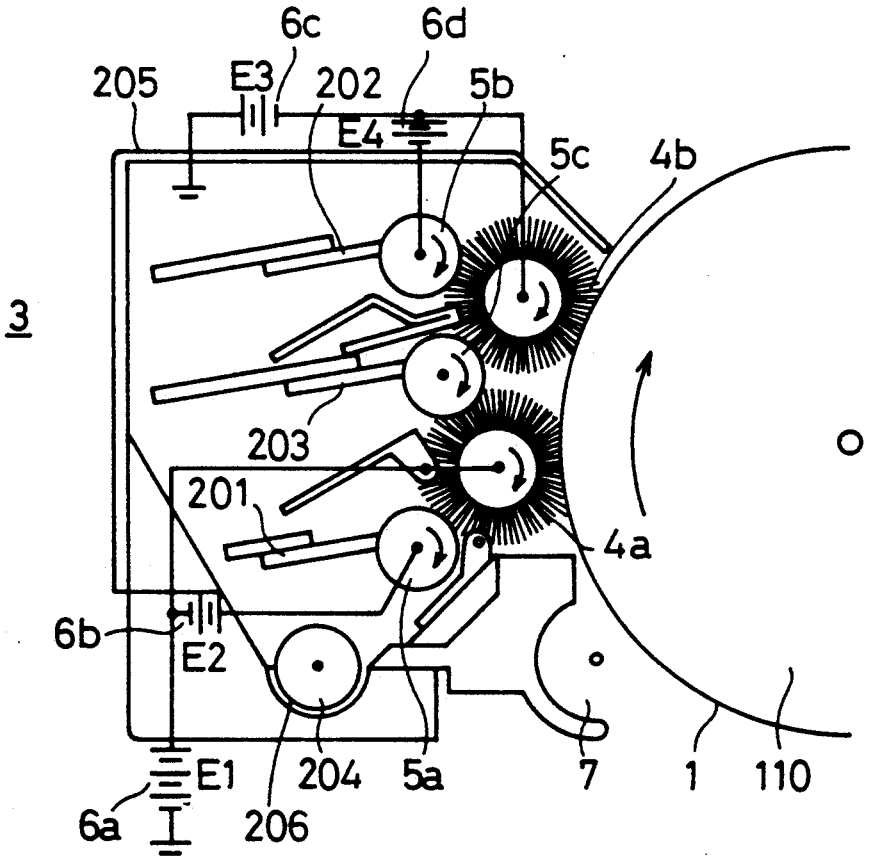
FIG. 3 is a schematic view of an embodiment of the cleaning unit of the present invention.

FIG. 3 is a schematic cross-sectional view of the inside of the cleaning unit 3.

The cleaning unit 3, which is arranged to adjoin the surface 1, is covered with a case 205 so that the toner recovered from the surface 1 does not scatter. At the uppermost stream side of the cleaning unit 3, a discharger 7 for decreasing the charge of residual toner by AC corona charging is arranged. In the downstream side of the discharger 7, a fur brush **4*a*, is arranged so that its tip is in contact with the surface 1. In the further downstream side thereof, a fur brush 4*b* is arranged in a manner similar to the fur brush 4*a*. A recovering roller 5*a* is provided to the fur brush 4*a* arranged in the upstream side so as to be in contact with the brush 4*a*, while a recovering roller 5*b* is provided to the fur brush 4*b* arranged in the downstream side so as to be in contact with the brush 4*b***. Further, between the fur brushes *4a* and **4*b*, a recovering roller 5*c* is arranged so as to be in contact with both of the brushes 4*a* and 4*b*. Blades 201, 202 and 203 are in contact with the three rollers 5*a*, 5*b* and 5*c*, respectively, in order to remove toner adhering the rollers 5*a*, 5*b* and 5*c*. Below the case 205, a toner tray 206 is provided and a screw roller 204** for discharging gathered toner is arranged.

Moreover, to the fur brush **4*a* arranged in the upstream side and the recovering roller 5*a* which is in contact only with the fur brush 4*a*, potential applying sources 6*a* and 6*b* for providing them with a necessary potential is connected, while to the fur brush 4*b* arranged in the downstream side and the recovering roller 5*b* which is in contact only with the fur brush 4*b*, potential applying sources 6*c* and 6*d*** for providing them with a necessary potential is connected.

Subsequently, the operation of this embodiment will be described.

In performing copying with a copying machine as shown in FIG. 2, when an original is set on the original glass plate 102 to start copying, the exposure lamp 103 irradiates a light beam onto the original while moving from the downstream side to the upstream side of the original glass plate 102. The light beam reflected by the original is vertically reflected by the mirror 104. Then, it is further reflected by the pair of movable mirrors 106 to enter the lens 105. The light beam having entered the lens 105 is reflected in a direction toward the surface 1 which is arranged diagonally to the lower side by the mirror 107 fixed in the side, of the lens 105, opposite to the mirror 106, and is formed into an image on the surface 1 of the photoreceptor drum 110.

Moreover, the photoreceptor drum 110 having the surface 1 is rotated. A portion, of the surface 1, which have come to the position of the charging electrode 112 is positively charged by the charging electrode 112. Then, a condition is obtained where a positive charge is accumulated on the external surface of the surface 1 which has been charged and where a negative charge is accumulated on the internal surface of the surface 1. When the image forming light beam strikes against the charged surface 1 as the photoreceptor drum 110 rotates, a light beam irradiated onto a white portion of the original is reflected to irradiate the surface 1; however, a light beam irradiated onto a black portion is hardly reflected so that the portion, on the surface 1, corresponding to the black portion is not irradiated. The positive charge on the external surface is neutralized by the negative charge on the internal surface and disappears, since the electrical resistance of the portion, on the surface 1, which is irradiated by the light beam decreases. The positive potential of the portion, which has not been irradiated, of the surface 1 remains intact to form an electrostatic latent image. When the electrostatic latent image formed on the surface 1 is rotated on the development unit 113, the development unit 113 brings negatively charged toner to the vicinity thereof. Since the latent image and the toner have opposite polarities, respectively, the toner adheres to the portion where the potential remains to form a visible image. The photoreceptor drum 110 further rotates under this condition, and a copy sheet conveyed from the paper feed cassette 120 by the paper re-feed roller 114 is put on the surface 1 to which the toner adheres. Then, when the positively charged transferring electrode 115 is brought in the vicinity from the side, of the copy sheet, opposite to the surface 1, the negatively charged toner adheres to the surface of the copy sheet separated from the surface 1. The copy sheet where the toner has been transferred adheres to the surface 1 due to electrostatic force. In order to separate it, the separating electrode 116 arranged to adjoin the downstream side of the transferring electrode 115 is negatively charged. The copy sheet separated by the separating electrode is conveyed to the fixing unit 118 by the paper conveying belt 117. The toner on the conveyed copy sheet is fixed by heat and pressure when the sheet passes between a heat roller and a press roller of the fixing unit 118. The copy sheet where the toner is fixed is discharged by the discharging roller 119.

Moreover, the toner on the surface 1 does not completely be removed by the transferring of toner onto the copy sheet. Residual toner exists there. It is necessary to remove the residual toner prior to the next copying operation. The cleaning unit 3 is attached for this purpose.

Subsequently, the operation of the cleaning unit 3 will be described with reference to FIG. 3.

The surface 1 to which toner adheres passes in the vicinity of the discharger 7 arranged at the uppermost stream position in the cleaning unit 3. The discharger 7 performs a function of decreasing the potential of the toner and the charge of the surface of the photoreceptor drum by generating an AC corona between electrodes. At this time, strongly negatively charged toner is brought into a weakly negatively charged condition, while weakly negatively charged toner is brought into a positively charged condition. Therefore, most of the residual toner on the surface 1 is weakly negatively charged, and a part thereof is weakly positively charged and reaches the fur brush 4*a* in the up stream side. The fur brush 4*a* is rotating about a rotation axis at a speed of approximately 200 rpm in a direction in the same as the photoreceptor drum 110. The fur brush 4*a* is provided with a positive potential E1 by the potential applying source 6*a*. The negatively charged residual toner is attracted to the fur brush 4*a* by frictional force and electrical attraction. The toner adhering to the fur brush 4*a* is brought in contract with the brush and rotates, and is attached to the recovering roller 5*a* which is provided with a potential higher (by E2) than that of the fur brush 4*a*. the toner adhering to the recovering roller 5*a* is rubbed off by the edge of the blade 201 arranged to adjoin the roller 5*a*.

The weakly positively charged toner remaining on the surface 1 is attracted to the fur brush 4*b* arranged in the downstream side when the toner is brought to the fur brush 4*b*, since the brush is provided with a negative potential −Es. the fur brush 4*b* may rotate at a very low speed of approximatley 15 rpm since the amount of the positively charged toner is only a little. Because of this low speed rotation of the brush, toner does not scatter, and the scattering of toner caused by the fur brush 4*a* arranged in the upstream side is also prevented. The toner adhering to the fur brush 4*b* adheres to the recovering roller 5*b* which is provided with a negative potential larger (by −E4) than that of the fur brush 4*b*, and is separated therefrom by the edge of the blade 202. The removing roller 5*c* is provided with a potential mediating between those of the fur brushes 4*a* and 4*b*. For example, when the fur brushes 4*a* and 4*b* are provided with potentails of +200 V and −200 V, respectively, the roller 5*c* is provided with a potential of −100 V. Thereby, positively charged toner which is mixed with the toner adhering to the fur brush 4*a* is separated Moreover, negatively charged toner which is mixed with the toner adhering to the fur brush 4*b* can be separated by use of a physical action.

The toner removed as described above is rubbed off to a toner tray provided below the case 205 of the cleaning unit 3. The gathered toner is returned to a toner hopper by the screw roller 204 and re-used.

While two fur brushes are employed in the above-described embodiment, the number of fur brushes may be three of more. The fur brush 4*b* may be rotated at a speed the same as that of which the fur brush 4*a* is rotated.

In the above-described embodiment, most of the residual toner on the surface of the photoreceptor drum is cleaned by a fur brush arranged in the upstream side. Since a fur brush arranged in the downstream side has only to clean a small amount of toner which remains there, cleaning is effectively performed even if the rotation speed of the fur brush is low. As a result, the scattering of toner can be prevented. Moreover, the electrical attraction between the surface of the photoreceptor drum and toner is decreased by previously discharging the toner, so that the toner is easier to remove.

Figure 4:
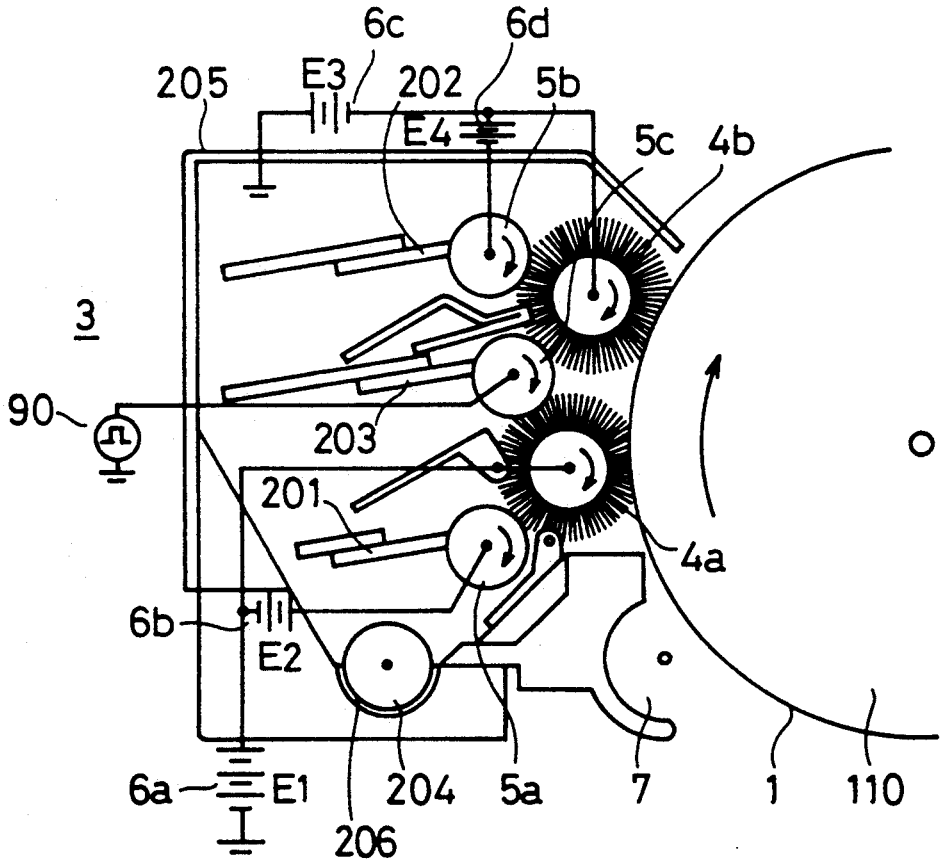
FIG. 4 is a schematic view of another embodiment of the cleaning unit of the present invention.

Another embodiment of the present invention is shown in FIG. 4. In FIG. 4, the same portions as those of FIG. 3 are provided with the same reference designations.

In this embodiment, to a recovering roller 5*c*, a rectangular wave voltage is applied by a rectangular wave voltage source 90. Therefore, the portion, of the recovering roller 5*c*, where a positive portion of the rectangular wave voltage is applied attracts the negatively charged toner on a fur brush 5*a*, while the portion where a negative portion of the rectangular wave voltage is applied attracts the positively charged toner on a fur brush 5*b*. The positively charged toner and negatively charged toner attracted to the recovering roller 5*c* as described above is rubbed off by a blade 203 as the recovering roller 5*c* rotates.

A sine wave voltage may be applied to the recovering roller 5*c* instead of the rectangular wave voltage. However, toner is more excellently attracted when a rectangular wave voltage is applied, since the portion where the voltage is changed between positive and negative is steeper in the rectangular wave voltage.

Obviously, many modifications and variations of the present invention are possible in light of the above teachings. It is therefore to be understood that within the scope of the appended claims, the invention may be practiced other than as specifically described.

What is claimed is:

1. A cleaning unit for removing residual toner comprising:

a plurality of rotatable fur brushes which are arranged so as to adjoin in a downstream direction of a transferring process on a surface of a photoreceptor drum and whose tips are in contact with said surface for removing residual toner on said surface;

a recovering roller which rotates in order to remove toner adhering to said fur brushes and which is arranged so as to be in contact with the tip of each of said fur brushes; and potential applying means for applying potential to said fur brushes and said recovering roller, wherein a fur brush arranged at the downmost stream side rotates at a lower speed compared to another fur brush arranged in the upstream side thereof.

2. A cleaning unit according to claim 1, further comprising discharging means, for decreasing a charge of the residual toner, which is arranged in the downstream side of the transferring process of said surface and in the upstream side of the uppermost stream side fur brush and which is arranged so as to adjoin said surface, wherein said potential applying means provides said downmost stream side fur brush with a potential of a pole reverse to that of the potential of said uppermost stream side fur brush.

3. A cleaning unit for removing residual toner on a surface of a photoreceptor drum for use in an image forming apparatus comprising:

a photoreceptor drum;

a first fur brush to which a positive voltage is applied in order to electrostatically attract negatively charged toner on the surface of said photoreceptor drum;

a second fur brush to which a negative voltage is applied in order to electrostatically attract positively charged toner on the surface of said photoreceptor drum;

a recovering roller which acts on both of said first and second rollers; and means for applying an AC rectangular wave voltage to said recovering roller.

4. A cleaning unit according to claim 3, further comprising: a first sub-covering roller which acts on said first fur brush and to which a positive voltage larger than the positive voltage of said first fur brush is applied; and a second sub-covering roller which acts on said second fur brush and to which a negative voltage larger than the negative voltage of said second fur brush is applied.

* * * * *